US007245476B2

(12) United States Patent
Komoriya et al.

(10) Patent No.: US 7,245,476 B2
(45) Date of Patent: Jul. 17, 2007

(54) STATIC ELIMINATOR USING ULTRAVIOLET LIGHT EMITTING DIODE

(75) Inventors: Shigeru Komoriya, Tsukuba-gun (JP); Satoshi Suzuki, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 595 days.

(21) Appl. No.: 10/629,561

(22) Filed: Jul. 30, 2003

(65) Prior Publication Data

US 2004/0027777 A1 Feb. 12, 2004

(30) Foreign Application Priority Data

Aug. 7, 2002 (JP) ..... 2002-264793

(51) Int. Cl.
*H01H 47/00* (2006.01)

(52) U.S. Cl. ..... 361/229; 361/220

(58) Field of Classification Search ..... 361/220, 361/229, 212

See application file for complete search history.

(56) References Cited

U.S. PATENT DOCUMENTS

| | | | | |
|---|---|---|---|---|
| 4,297,423 | A * | 10/1981 | Nishikawa | 430/54 |
| 6,146,813 | A * | 11/2000 | Girard et al. | 430/319 |
| 6,191,759 | B1 * | 2/2001 | Kintz | 345/8 |
| 6,734,443 | B2 * | 5/2004 | Zheng et al. | 250/492.1 |
| 6,816,991 | B2 * | 11/2004 | Sanghani | 714/733 |
| 6,838,678 | B1 * | 1/2005 | Bujak et al. | 250/455.11 |

* cited by examiner

*Primary Examiner*—Stephen W. Jackson
(74) *Attorney, Agent, or Firm*—Oblon, Spivak, McClelland, Maier & Neustadt, P.C.

(57) ABSTRACT

A static eliminator for neutralizing and eliminating static electricity by applying an ultraviolet ray to a static elimination target includes at least one means for applying the ultraviolet ray and the means for applying the ultraviolet ray is formed of an ultraviolet light emitting diode.

11 Claims, 6 Drawing Sheets

(a)

(b)

STATIC ELIMINATOR USING ULTRAVIOLET LIGHT EMITTING DIODE

TECHNICAL FIELD

The present invention relates to a static eliminator for neutralizing and eliminating static electricity of a static elimination target by ultraviolet irradiation and more concretely to a static eliminator useful when used in a field of a manufacturing technique in which semiconductor-related minute parts are mounted or assembled, or in a field of a manufacturing technique in which a product which hates adhesion of dust and moisture due to blowing of air is handled.

PRIOR ART

In a field of a semiconductor-related manufacturing technique, in order to prevent minute parts from coming in close contact with each other and from adsorbing dust with static electricity to be defectives due to electrostatic buildup on the part, static elimination is carried out in processing, mounting, or the like of the parts by using a method of blowing ionized air on the parts in advance or the like.

To put it concretely, by using an ionizer for ionizing surrounding air by applying a high voltage to discharge electrodes to generate corona discharge, the air ionized by the ionizer is supplied as an air flow to the static elimination target from which the static electricity should be eliminated.

However, in the method of static elimination by the ionized air flow, the part itself may be blown away if blowing of the air flow is too strong. Especially in neutralizing and eliminating static electricity of a small and unstably-retained part such as a part retained at a tip end of a part retaining portion of a part mounting machine, the part may be blown away or the static elimination requires much time unless a flow rate of the air is adjusted sufficiently. Moreover, the air flow blows up surrounding dust to cause the dust to adhere to the part or to cause moisture to adhere to the part by the air flow, which may produce defectives.

On the other hand, there is also a conventionally known technique (see Japanese Patent Application Laid-open No. 9-69478, for example) of neutralizing and eliminating static electricity by applying an ultraviolet ray to a target from which the static electricity should be eliminated by using an ultraviolet lamp to thereby ionize gas molecules around the target. Utilized in this ultraviolet irradiation is a phenomenon in which charge of the static elimination target is neutralized by ionization of the surrounding gas molecules or emission of photoelectrons from the target and the like by the ultraviolet ray as a result of the ultraviolet irradiation.

In a case of using a vessel such as the ultraviolet lamp and also in a case of using the above-described ionizer by corona discharge between the discharge electrodes, because an apparatus itself takes up certain space, it is difficult to eliminate static electricity of the relatively small static elimination target related to the semiconductor in a concentrated manner and with efficiency. As a result, although it is advantageous to use the apparatus for neutralizing and eliminating the static electricity of a large number of parts by one operation prior to processing, mounting, and the like of the parts or to use the apparatus for globally neutralizing and eliminating a wide range of static electricity, use of the apparatus is limited due to a size of the apparatus.

However, the parts to be subjected to processing and mounting may be electrically charged due to friction or the like in transferring and picking-up of the parts in many cases. Even if the large number of parts are subjected to static elimination in advance by using the above-described methods, no significant static eliminating effects can be expected, because static electricity may be generated again. For reliable static elimination, it is desired that static elimination can be performed while conducting processing and mounting. For this purpose, consideration must be given to miniaturization of the apparatus for static elimination or adaptability of a structure of the apparatus to a shape of the static elimination target so as to always dispose the apparatus close to the static elimination target during processing and mounting.

DISCLOSURE OF THE INVENTION

Figure 1:
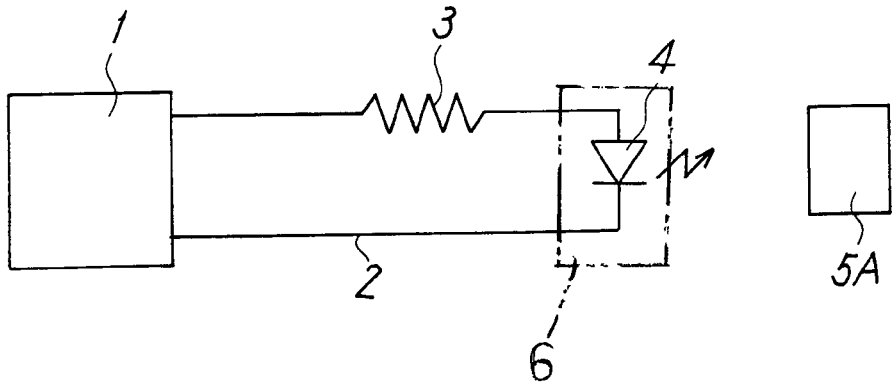
FIG. 1 is a schematic block diagram showing a basic structure of a static eliminator according to the present invention.

It is a technical object of the present invention, to provide a static eliminator for neutralizing and eliminating static electricity by ultraviolet irradiation of a static elimination target, in which not a vessel such as an ultraviolet lamp but a small generating source is used as a generating source of an ultraviolet ray, thereby enabling the static eliminator to be miniaturized and disposed close to the static elimination target and efficiently irradiating the static elimination target with the ultraviolet ray to neutralize and eliminate the static electricity.

It is another technical object of the invention to provide a static eliminator in which means for applying an ultraviolet ray can be disposed very close to the static elimination target and application of the ultraviolet ray to portions which do not need the application can be reduced to a small amount.

It is another technical object of the invention to provide a static eliminator in which small means for applying ultraviolet rays are used and grouped to thereby form a generating source of ultraviolet rays of an arbitrary size and shape adapted to a size, a shape, and the like of the static elimination target and to thereby uniformly apply the ultraviolet rays to the static elimination target.

It is another technical object of the invention to provide a static eliminator in which air around the static elimination target is directly ionized by ultraviolet irradiation from a very close position to thereby make the above air blowing for the static elimination basically unnecessary, dust and moisture do not have to be blown on the static elimination target, and clean static elimination is possible.

To achieve the above objects, according to the invention, there is provided a static eliminator for neutralizing and eliminating static electricity by applying an ultraviolet ray to a static elimination target, the static eliminator including at least one means for applying the ultraviolet ray and the means for applying the ultraviolet ray being formed of an ultraviolet light emitting diode.

In the static eliminator having the above structure, because the ultraviolet light emitting diode is used as the means for applying the ultraviolet ray, a generating source of the ultraviolet ray can be miniaturized and the static eliminator can be disposed close to the target. As a result, it is possible to efficiently apply the ultraviolet ray to the target to neutralize and eliminate the static electricity of the target.

In the static eliminator of the invention, in order to eliminate static electricity of a minute static elimination target, it is also possible to provide optical means formed of a lens or the like between the ultraviolet light emitting diode and the static elimination target to condense the ultraviolet ray from the ultraviolet light emitting diode and to apply the ultraviolet ray to the static elimination target.

In the invention, it is also possible to dispose an air nozzle near the ultraviolet light emitting diode to produce a gentle flow of air ionized by the ultraviolet ray from a side of the ultraviolet light emitting diode toward the static elimination target.

Moreover, according to the invention, it is also possible to provide a wall member for ejecting ions under ultraviolet irradiation in a position facing at least a part of an optical path extending from the ultraviolet light emitting diode to the static elimination target to thereby facilitate generation of ions to enhance a static eliminating effect. In this case, the wall member includes a photocatalyst or is formed of a photoemissive member.

If generation of ozone is desirable as a result of generation of ions by ultraviolet irradiation, it is possible to provide a wall member for generating ozone under ultraviolet irradiation in a position facing at least a part of an optical path extending from the ultraviolet light emitting diode to the static elimination target. On the contrary, if generation of ozone is undesirable, it is possible to provide a wall member for absorbing or decomposing ozone to suppress influences of ozone.

In the invention, a plurality of ultraviolet light emitting diodes may be mounted to a support member disposed to face the static elimination target. As one form of this, the support member has a shape and a size corresponding to the static elimination target and the ultraviolet light emitting diodes are disposed throughout a face of the support member. As another form, the support member is in a ring shape and the plurality of ultraviolet light emitting diodes are mounted to an inner face of the support member to thereby concentrate application of the ultraviolet rays from the ultraviolet light emitting diodes on the static elimination target positioned on a central axis of the support member.

According to the invention, there is provided a static eliminator for neutralizing and eliminating static electricity by applying an ultraviolet ray to a belt-shaped static elimination target. The static eliminator includes an irradiating head formed by mounting a plurality of ultraviolet light emitting diodes to a bar-shaped support member and the irradiating head is disposed in such a direction as to cross the static elimination target in a width direction and is movable with respect to the static elimination target along the target.

Furthermore, according to the invention, there is provided a static eliminator for neutralizing and eliminating static electricity by applying an ultraviolet ray to a rotationally symmetric inner or outer peripheral face of the static elimination target. The static eliminator includes an irradiating head formed by mounting a plurality of ultraviolet light emitting diodes to a support member movable along the inner or outer peripheral face.

DETAILED DESCRIPTION

FIG. 1 shows a basic structure of a static eliminator according to the present invention. The static eliminator is characterized in that an ultraviolet light emitting diode 4 is used as a means for applying an ultraviolet ray. In other words, the static eliminator includes an irradiating head 6 formed of the ultraviolet light emitting diode 4 and the light emitting diode 4 is connected to a current-carrying circuit 2 electrically communicating with a power-supply unit 1 having a control mechanism through a resistor 3. A plurality of light emitting diodes 4 may be provided. In this case, the respective diodes 4 may be turned on and off individually or in unison.

The static eliminator applies the ultraviolet ray from the light emitting diode 4 to a static elimination target 5A of every kind and ionizes gas (air) around the static elimination target 5A by the ultraviolet ray to eliminate static electricity of the static elimination target 5A.

Because the static eliminator having the above structure uses the ultraviolet light emitting diode 4 as means for applying the ultraviolet ray, a generating source of the ultraviolet ray is miniaturized and the light emitting diode 4 can be disposed close to the static elimination target 5A. As a result, it is possible to efficiently apply the ultraviolet ray to the static elimination target to effectively neutralize and eliminate the static electricity of the target. Furthermore, as will be described below, a plurality of light emitting diodes 4 can be disposed in an arrangement of an arbitrary shape adapted to a shape of the target.

Because the generating source of the ultraviolet ray is small, the generating source can be attached to a processing machine or a mounting machine for the static elimination target and the static elimination target can be subjected to the static elimination while being processed or mounted. As a result, electrification due to friction or the like during processing, transferring, and picking-up of the parts can be suppressed and significant and a reliable static eliminating effect can be obtained.

Figure 2:
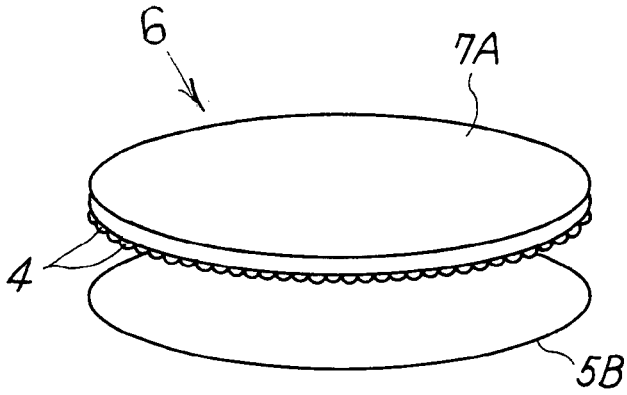
FIG. 2 is a perspective view of a structure of a static eliminator when a static elimination target is in a disc shape.

If a surface of the target is in a shape of a two-dimensional or three-dimensional face, e.g., if a static elimination target 5B is in a disc shape, as shown in FIG. 2, an irradiating head 6 formed by mounting a plurality of light emitting diodes 4 throughout a lower face of a disc-shaped support member 7A having a shape and a size corresponding to a shape of the face to be irradiated with the ultraviolet rays may be used to apply the ultraviolet rays to the static elimination target by the irradiating head 6. In this case, the light emitting diodes 4 are preferably disposed uniformly at regular intervals on the lower face of the support member 7A. Although it is not especially shown in the drawings, the respective light emitting diodes 4 of the irradiating head 6 are connected to the power-supply unit 1 as a matter of course similarly to FIG. 1. The same goes for light emitting diodes 4 of respective embodiments described below.

With this static eliminator, the static electricity can be eliminated efficiently in a short time not only from a disc-shaped static elimination target but from a target in an arbitrary complicated shape by using an irradiating head adapted to such a shape.

Figure 3:
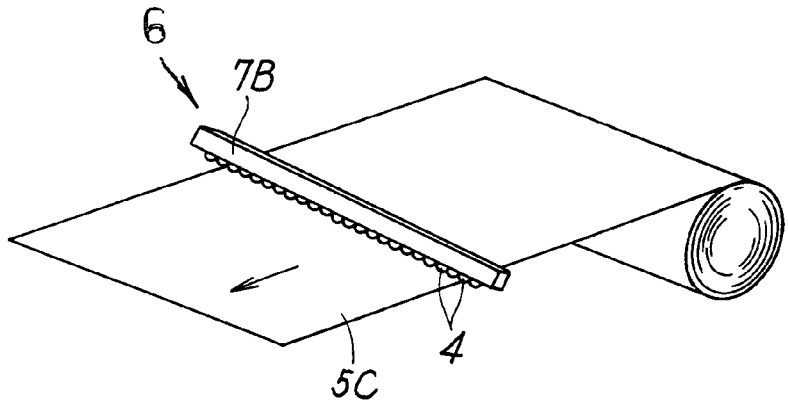
FIG. 3(*a*) is a perspective view of a structure of a static eliminator used for a belt-shaped static elimination target such as a synthetic resin film and FIG. 3(*b*) is a bottom view of a support member and showing a state of an arrangement of ultraviolet light emitting diodes in the static eliminator as an example.
Figure 3:
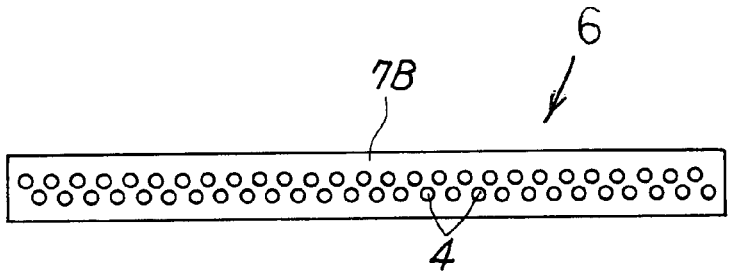

FIGS. 3(*a*) and 3(*b*) show a structure of a static eliminator used when a static elimination target 5C is in a shape of a belt formed of a synthetic resin film, cloth, or the like. As shown in the FIGS., An irradiating head 6 of this static eliminator has a structure in which a plurality of ultraviolet light emitting diodes 4 are mounted at regular intervals in rows to a bar-shaped support member 7B and is disposed in such a direction as to be orthogonal to a longitudinal direction of the static elimination target 5C, i.e., to cross the static elimination target 5C in a width direction. In this case, a length of the rows of the light emitting diodes 4 needs to be equal to or greater than a width of the static elimination target 5C. Although the number of rows of the light emitting diode 4 may be one, a static eliminating effect can be enhanced and static elimination time can be shortened by providing a plurality of rows as shown in FIG. 3(*b*).

In a case of this static eliminator, in ordinary cases, the support member 7B is disposed at a portion over which the belt-shaped static elimination target 5C runs and ultraviolet rays are applied to a surface of the static elimination target 5C to eliminate static electricity while causing the target 5C to run in its longitudinal direction (a direction of an arrow). However, it is also possible to reciprocate the support member 7B with respect to the static elimination target 5C at temporary rest. In other words, both the static elimination target 5C and the support member 7B may be disposed to be movable with respect to each other in the longitudinal direction of the static elimination target 5C to eliminate the static electricity during the relative movements.

Figure 4:
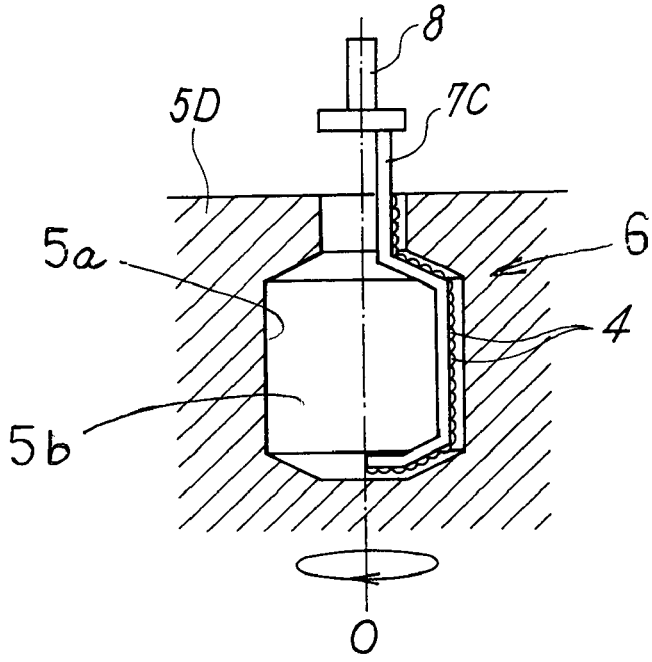
FIG. 4 is a sectional view of a static eliminator suitable for a static elimination target in a shape of a container.

FIG. 4 shows an embodiment of a static eliminator suitable for eliminating static electricity of a rotationally symmetric inner peripheral face 5*a* of a static elimination target 5D in a shape of a container or a cylinder. An irradiating head 6 of this static eliminator has a support member 7C in a shape adapted to a shape of the inner peripheral face which is a section of a hollow portion 5*b* of the static elimination target 5D along a central axis O. The irradiating head 6 is formed by mounting a plurality of ultraviolet light emitting diodes 4 to an outer face of the support member 7C. By inserting the irradiating head 6, i.e., the support member 7C into the hollow portion 5*b* of the static elimination target 5D and rotating it about the central axis O, the whole inner peripheral face 5*a* is subjected to static elimination. In this case, it is also possible to keep the support member 7C at rest and to rotate the static elimination target 5D. It is also possible to rotate both the support member 7C and the static elimination target 5D in opposite directions to each other.

Although the case of static elimination of the inner peripheral face 5*a* of the static elimination target 5D is shown here, it is also possible to subject an outer peripheral face to static elimination. In this case, the support member is formed into a shape adapted to the outer peripheral face of the static elimination target and one or both of the support member and the static elimination target is (are) rotated.

Figure 5:
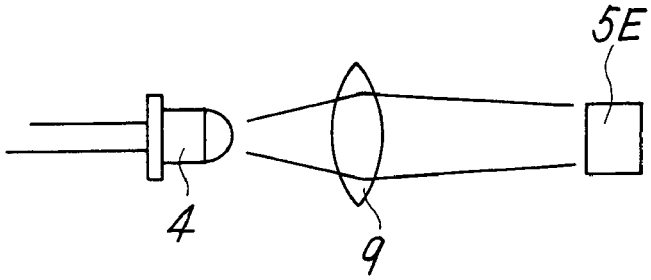
FIG. 5 shows an embodiment of the static eliminator effective at eliminating static electricity of a minute static elimination target and is a vertical sectional view of an essential portion of the static eliminator.

FIG. 5 shows an embodiment of a static eliminator effective at eliminating static electricity of a minute static elimination target 5E. In this static eliminator, an optical system 9 for light gathering is disposed between an ultraviolet light emitting diode 4 and the target 5E and an ultraviolet ray from the light emitting diode 4 is condensed by the optical system 9 and applied to a surface of the static elimination target 5E. As the optical system 9, not only a lens shown in the drawing but any optical system having a function of condensing the ultraviolet ray can be used.

If the lens is provided between the light emitting diode 4 and the static elimination target for gathering light and application of the ultraviolet ray in other directions is suppressed as described above, influences of the ultraviolet ray on other portions can be minimized while enhancing a static eliminating effect.

Figure 6:
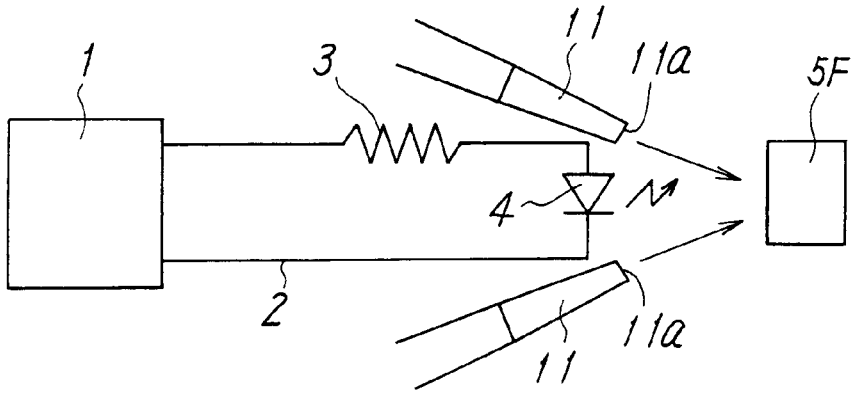
FIG. 6 is a block diagram of an embodiment in which an air flow is supplied to a static elimination target.

FIG. 6 shows the static eliminator described by using FIG. 1 and provided with a plurality of air nozzles 11 as additional components. These air nozzles 11 are disposed near the light emitting diode 4 with their spraying holes 11*a* directed toward a static elimination target 5F. By spraying air from the spraying holes 11*a* dead slow, flows of air toward the target 5F are generated. By actively sending air ionized by ultraviolet irradiation toward the static elimination target, the static eliminating effect is enhanced. Spraying of air from the above nozzles is not a necessity for the static elimination and therefore may be of such an appropriate volume of air as not to blow the static elimination target away. Portions similar or corresponding to those of the embodiment in FIG. 1 are provided with reference numerals similar to those in FIG. 1.

Figure 7:
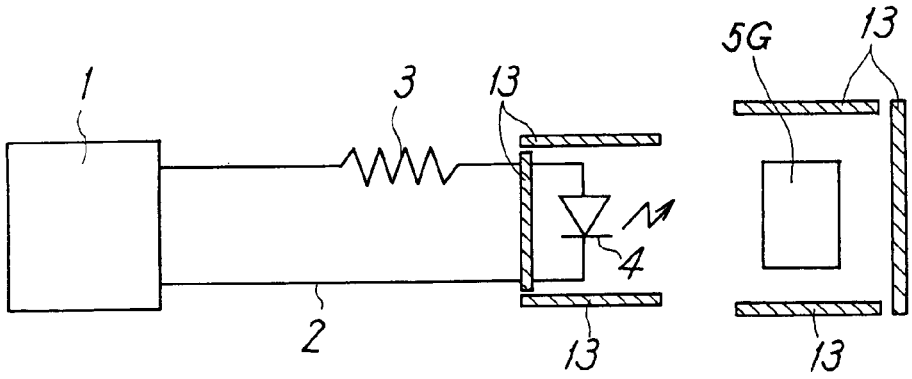
FIG. 7 is a schematic explanatory view of an embodiment in which a wall member having a photocatalyst or a photoemissive wall member is disposed.

FIG. 7 shows the static eliminator described by using FIG. 1 and provided with a wall member 13 for ejecting ions under ultraviolet irradiation as an additional component around an optical path extending from the light emitting diode 4 to a static elimination target 5G. The wall member 13 may be formed by containing photocatalyst having a function of ejecting ions in a base material or may be formed of a photoemissive member. The wall member 13 does not need to surround the whole optical path but may be disposed in such a position as not to obstruct application of the ultraviolet ray to the static elimination target 5G to surround at least a part of the optical path.

By providing such a wall member 13 to the static eliminator, generation of ions is facilitated by application of a part of the ultraviolet ray from the light emitting diode 4 to the wall member 13 and the static eliminating effect is further enhanced. Portions similar or corresponding to those of the embodiment in FIG. 1 are provided with reference numerals similar to those in FIG. 1.

Figure 8:
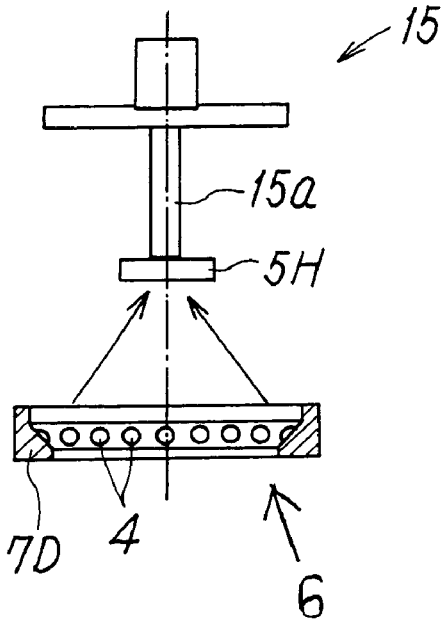
FIG. 8 is a sectional view of an example of a structure of a static eliminator mounted to a part mounting machine.

FIG. 8 shows another embodiment of the static eliminator of the invention. The static eliminator of this embodiment can be provided to a part mounting machine 15 for retaining a static elimination target 5H with a part retaining portion 15*a* and mounting the target 5H in a predetermined position. The part mounting machine 15 retains the minute static elimination target 5H at a tip end of the rod-shaped part retaining portion 15*a* by vacuum suction or the like and moves the target 5H to the predetermined position by a robot arm or the like for processing and mounting.

An irradiating head 6 of the static eliminator has an annular support member 7D and a plurality of ultraviolet light emitting diodes 4 are mounted at substantially regular intervals to an inner peripheral face of the support member 7D. Application of ultraviolet rays from the light emitting diodes 4 can be concentrated substantially on a point on a central axis of the support member 7D or in a vicinity of the point. The irradiating head 6 is disposed coaxially with a moving path of the part retaining portion 15*a* and is fixed in such a position as to be able to apply ultraviolet rays to the static elimination target 5H and the ultraviolet rays are applied from the respective light emitting diodes 4 to the static elimination target 5H.

Figure 9:
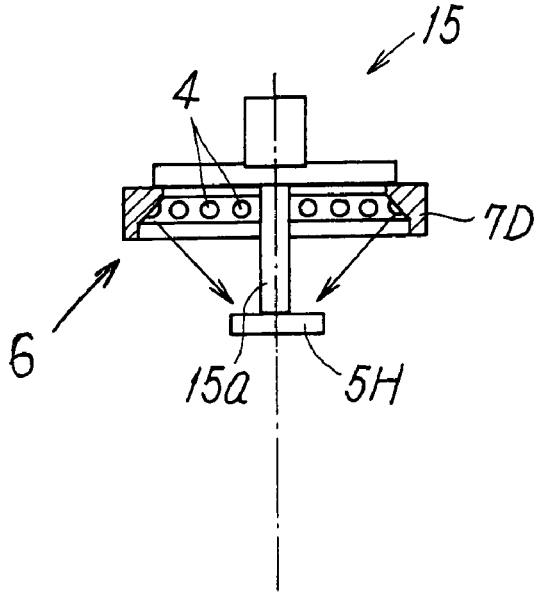
FIG. 9 is a sectional view of a variation of the embodiment in FIG. 8.

As shown in FIG. 9, the static eliminator in FIG. 8 may be concentrically fixed to a base portion of the rod-shaped part retaining portion 15*a* of the part mounting machine 15 such that the ultraviolet rays from the ultraviolet light emitting diodes 4 are applied toward the static elimination target 5H retained by the part retaining portion 15*a* and may constantly move with the static elimination target 5H while maintaining a certain positional relationship with the target 5H.

By carrying out the above-described ultraviolet irradiation for static elimination, ozone is also generated as ions are generated and generation of ozone may cause inconvenience in not a few cases.

Figure 10:
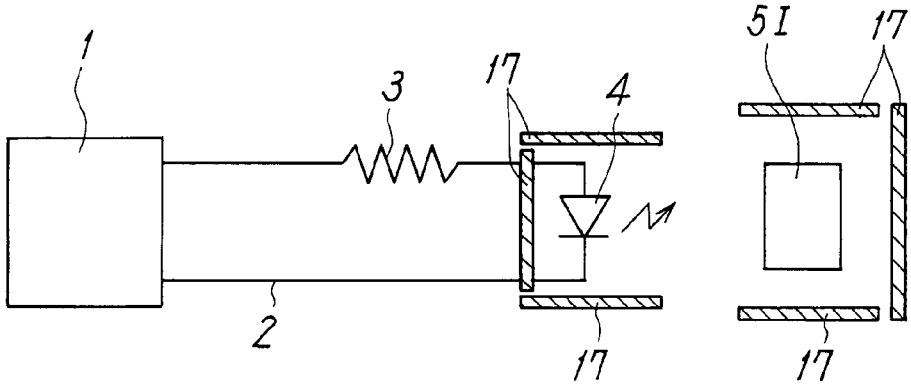
FIG. 10 is a schematic explanatory view of an embodiment in which generated ozone is absorbed or decomposed.

In an embodiment of FIG. 10, in the static eliminator in FIG. 1, a wall member 17 having a function of absorbing or decomposing ozone is provided around an optical path extending from an ultraviolet light emitting diode 4 to a static elimination target 5I and it is possible to suppress an influence of ozone on some of the static elimination target 5I and peripheral devices which hate an existence of ozone. The wall member 17 may be formed by containing a catalyst for decomposing ozone in a base material or may be formed of a member itself which has an ozone-absorbing characteristic. The wall member 17 does not need to surround the whole optical path and may be disposed in such a position as not to obstruct application of the ultraviolet ray to the static elimination target 5I to surround at least a part of the optical path.

On the contrary, if generation of ozone is desirable for the static elimination target 5I or the peripheral devices, generation of ozone is utilized as it is and it is also possible that the wall member 17 further has a function of generating ozone by ultraviolet irradiation. In this case, the wall member 17 may be formed by containing an ozone generating catalyst in a base material. In this case, it is possible to use the static eliminator itself as an ozone generator.

The optical mechanism for light gathering and shown in FIG. 5, the nozzle mechanism shown in FIG. 6, the wall members shown in FIGS. 7 and 10, and the like can also be used for the static eliminators in forms shown in FIGS. 2 to 4, 8, and 9.

According to the static eliminator of the invention using the ultraviolet light emitting diode and described above in detail, in neutralizing and eliminating the static electricity by applying the ultraviolet ray to the static elimination target, the generating source of the ultraviolet ray can be miniaturized or can be formed into the arbitrary shape adapted to the shape of the static elimination target. Therefore, it is possible to efficiently apply the ultraviolet ray to the target and to neutralize and eliminate the static electricity.

Because the ultraviolet light emitting diode lasts longer than other sources of the ultraviolet ray, the diode may be maintenance-free. The ultraviolet light emitting diode does not produce heat as compared with a case in which the vessel is used, inconvenience caused by such heat can be avoided, and it is possible to achieve power and energy savings.

The invention claim is:

1. A static eliminator for neutralizing and eliminating static electricity by applying an ultraviolet ray to a static elimination target, the static eliminator comprising:

at least one means for applying the ultraviolet ray and the means for applying the ultraviolet ray being formed of an ultraviolet light emitting diode; and optical means for condensing the ultraviolet ray from the ultraviolet light emitting diode and applying the ultraviolet ray to the static elimination target.

2. A static eliminator for neutralizing and eliminating static electricity by applying an ultraviolet ray to a static elimination target, the static eliminator comprising:

at least one means for applying the ultraviolet ray and the means for applying the ultraviolet ray being formed of an ultraviolet light emitting diode; and an air nozzle for producing a flow of air ionized by the ultraviolet ray from a side of the ultraviolet light emitting diode toward the static elimination target.

3. A static eliminator for neutralizing and eliminating static electricity by applying an ultraviolet ray to a static elimination target, the static eliminator comprising:

at least one means for applying the ultraviolet ray and the means for applying the ultraviolet ray being formed of an ultraviolet light emitting diode; and a wall member for ejecting ions under ultraviolet irradiation in a position facing at least a part of an optical path extending from the ultraviolet light emitting diode to the static elimination target.

4. A static eliminator according to claim 3, wherein the wall member includes a photocatalyst or is formed of a photoemissive member.

5. A static eliminator for neutralizing and eliminating static electricity by applying an ultraviolet ray to a static elimination target, the static eliminator comprising:

at least one means for applying the ultraviolet ray and the means for applying the ultraviolet ray being formed of an ultraviolet light emitting diode; and a wall member for generating ozone under ultraviolet irradiation in a position facing at least a part of an optical path extending from the ultraviolet light emitting diode to the static elimination target.

6. A static eliminator for neutralizing and eliminating static electricity by applying an ultraviolet ray to a static elimination target, the static eliminator comprising:

at least one means for applying the ultraviolet ray and the means for applying the ultraviolet ray being formed of an ultraviolet light emitting diode; and a wall member having a function of absorbing or decomposing ozone generated by ultraviolet irradiation in a position facing at least a part of an optical path extending from the ultraviolet light emitting diode to the static elimination target.

7. A static eliminator according for neutralizing and eliminating static electricity by applying an ultraviolet ray to a static elimination target, the static eliminator comprising:

at least one means for applying the ultraviolet ray, wherein the means for applying the ultraviolet ray is formed of a plurality of ultraviolet light emitting diodes mounted to a support member disposed to face the static elimination target.

8. A static eliminator according to claim 7, wherein the support member has a shape and a size corresponding to the static elimination target and the ultraviolet light emitting diodes are disposed throughout a face of the support member.

9. A static eliminator according to claim 7, wherein the support member is in a ring shape and the plurality of ultraviolet light emitting diodes are mounted to an inner face of the support member to thereby concentrate application of the ultraviolet rays from the ultraviolet light emitting diodes on the static elimination target positioned on a central axis of the support member.

10. A static eliminator for neutralizing and eliminating static electricity by applying an ultraviolet ray to a belt-shaped static elimination target, the static eliminator comprising an irradiating head formed by mounting a plurality of ultraviolet light emitting diodes to a bar-shaped support member and the irradiating head being disposed in such a direction as to cross the static elimination target in a width direction and being movable with respect to the static elimination target along the target.

11. A static eliminator for neutralizing and eliminating static electricity by applying an ultraviolet ray to a rotationally-symmetric inner or outer peripheral face of a static elimination target, the static eliminator comprising an irradiating head formed by mounting a plurality of ultraviolet light emitting diodes to a support member movable along the inner or outer peripheral face.

* * * * *